US010670281B2

(12) United States Patent
Jones et al.

(10) Patent No.: US 10,670,281 B2
(45) Date of Patent: Jun. 2, 2020

(54) OUTDOOR TOP COVER HAVING INTEGRATED DRAIN FEATURES

(71) Applicant: Trane International Inc., Davidson, NC (US)

(72) Inventors: Steven Jones, Frisco, TX (US); Richard L. Jameson, Tyler, TX (US); Kirby N. Bicknell, Tyler, TX (US)

(73) Assignee: Trane International Inc., Davidson, NC (US)

( * ) Notice: Subject to any disclaimer, the term of this patent is extended or adjusted under 35 U.S.C. 154(b) by 129 days.

(21) Appl. No.: 15/926,532

(22) Filed: Mar. 20, 2018

(65) Prior Publication Data

US 2019/0293307 A1 Sep. 26, 2019

(51) Int. Cl.
*F24F 1/56* (2011.01)
*F24F 1/58* (2011.01)

(52) U.S. Cl.
CPC ..... *F24F 1/56* (2013.01)

(58) Field of Classification Search
CPC ..... F24F 1/56; F24F 1/58
USPC ..... 62/285
See application file for complete search history.

(56) References Cited

U.S. PATENT DOCUMENTS 4,723,419 A * 2/1988 Kessler ..... F24F 1/38 165/145
D453,559 S 2/2002 Mutchnik et al.
6,705,105 B2 3/2004 Wendt et al.
6,912,766 B2 7/2005 Wendt et al.

FOREIGN PATENT DOCUMENTS

CN 206919218 U * 1/2018

OTHER PUBLICATIONS

Wang Hongsheng, Waterproof type air condensing units, Jan. 2018, European Patent Office, English Translation (Year: 2018).*

* cited by examiner

*Primary Examiner* — Steve S Tanenbaum
(74) *Attorney, Agent, or Firm* — Conley Rose, P.C.; J. Robert Brown, Jr.; Kristian R. Sullivan

(57) ABSTRACT

Described herein are embodiments of a top cover for an outdoor HVAC unit. The top cover may comprise a dome-shaped top surface; outer edges surrounding the dome-shaped top surface; at least one ventilated grille disposed between the outer edges and the outdoor unit; and a plurality of channels configured to drain water from the dome-shaped top surface and away from the at least one ventilated grille.

20 Claims, 6 Drawing Sheets

OUTDOOR TOP COVER HAVING INTEGRATED DRAIN FEATURES

CROSS-REFERENCE TO RELATED APPLICATIONS

Not applicable.

STATEMENT REGARDING FEDERALLY SPONSORED RESEARCH OR DEVELOPMENT

Not applicable.

REFERENCE TO A MICROFICHE APPENDIX

Not applicable.

BACKGROUND

Heating, ventilation, and/or air conditioning (HVAC) systems may generally be used in residential and/or commercial structures to provide heating and/or cooling in order to create comfortable temperatures inside areas associated with such structures. To provide conditioned airflow into such conditioned areas, most HVAC systems employ an air conditioning unit having a fan to move the conditioned air through the HVAC system and into the climate conditioned areas. A top cover may be provided to protect the fan and other components within the air conditioning unit.

SUMMARY OF THE DISCLOSURE

In an embodiment, a top cover for an outdoor HVAC unit is provided. The top cover may comprise a dome-shaped top surface; outer edges surrounding the dome-shaped top surface; at least one ventilated grille disposed between the outer edges and the outdoor unit; and a plurality of channels configured to drain water from the dome-shaped top surface and away from the at least one ventilated grille.

In another embodiment, a heating, ventilation, and/or air conditioning HVAC system is provided. The HVAC system may comprise an outdoor unit; and a top cover configured to shield an interior of the outdoor unit. The top cover may comprise a dome-shaped top surface; outer edges surrounding the dome-shaped top surface; at least one ventilated grille disposed between the outer edges and the outdoor unit; and a plurality of channels configured to drain water from the dome-shaped top surface and away from the at least one ventilated grille.

For the purpose of clarity, any one of the embodiments disclosed herein may be combined with any one or more other embodiments disclosed herein to create a new embodiment within the scope of the present disclosure.

BRIEF DESCRIPTION OF THE DRAWINGS

For a more complete understanding of the present disclosure and the advantages thereof, reference is now made to the following brief description, taken in connection with the accompanying drawings and detailed description.

DETAILED DESCRIPTION

It should be understood at the outset that although illustrative implementations of one or more embodiments of the present disclosure are provided below, the disclosed systems and/or methods may be implemented using any number of techniques, whether currently known or in existence. The disclosure should in no way be limited to the illustrative implementations, drawings, and techniques illustrated below, including the exemplary designs and implementations illustrated and described herein, but may be modified within the scope of the appended claims along with their full scope of equivalents.

Outdoor HVAC units such as air conditioning units and heat pumps may include a weather guard or plastic top cover to prevent weather elements (e.g., snow, rain, leaves, etc.) from entering the interior parts of these units. Such weather elements may enter an outdoor unit through a fan grille, which generally defines a louvered region through which a fan may discharge air from the outdoor unit. The weather guard or top cover typically includes a solid flat surface designed to create a barrier between weather elements and the outdoor unit. However, during heating season, water resulting from freezing rain or snow may melt and flow freely over the flat surface of the top cover. As the water temperature may be near freezing, air discharged by the fan may cause such water to freeze upon impact with the open air louvered regions. Over time, ice may accumulate over the louvered airflow regions and significantly block airflow. Such air blockage may deteriorate efficiency and performance of the outdoor unit, or even cause unit failure in some cases. To address these and other issues, embodiments of the present disclosure provide water mitigation techniques including an outdoor top cover having integrated drain features to shield the louvered airflow regions from water.

Figure 1:
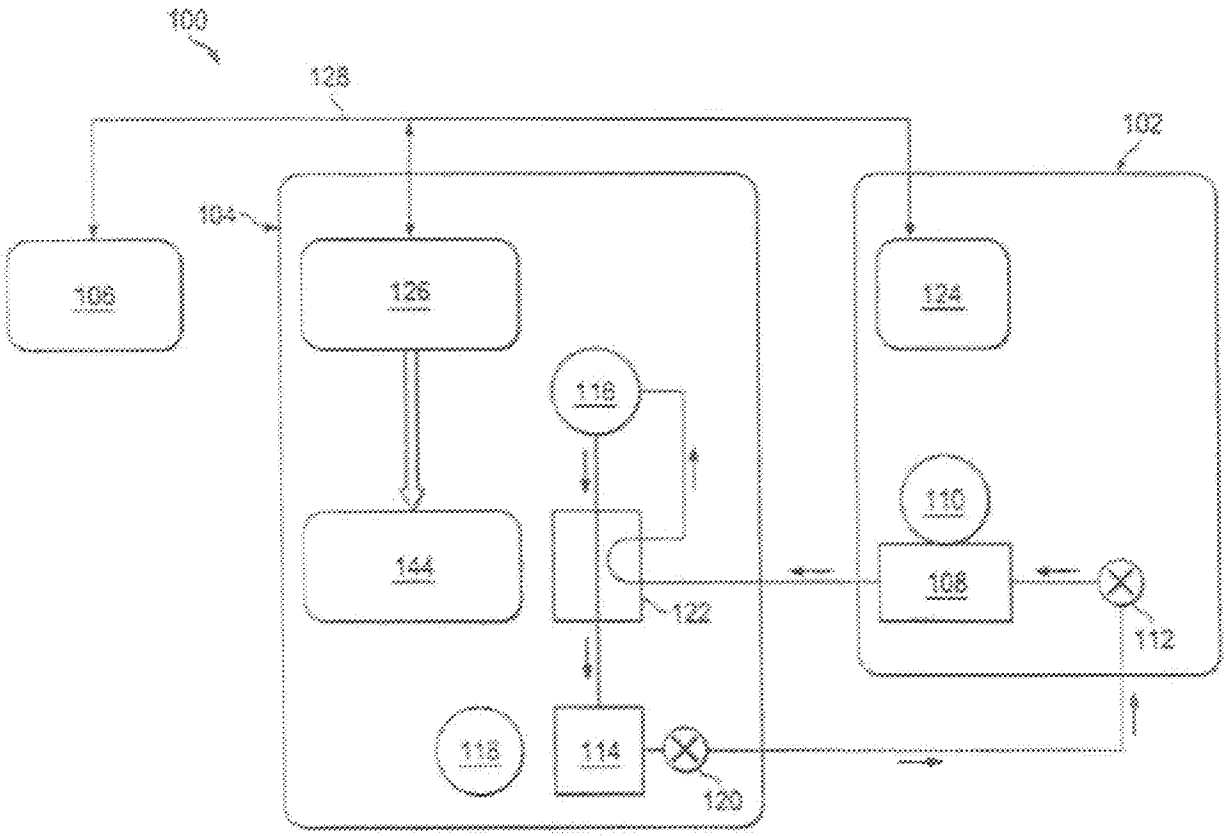
FIG. 1 is a schematic diagram of a heating, ventilation, and/or air conditioning (HVAC) system according to an embodiment of the disclosure.

Referring now to FIG. 1, a schematic diagram of a heating, ventilation, and/or air conditioning (HVAC) system 100 is shown according to an embodiment of the disclosure. Most generally, the HVAC system 100 may be configured to implement one or more substantially closed thermodynamic refrigeration cycles to provide a cooling functionality (hereinafter "cooling mode") and/or a heating functionality (hereinafter "heating mode"). The HVAC system 100 may comprise an indoor unit 102, an outdoor unit 104, and a system controller 106 that may generally control operation of the indoor unit 102 and/or the outdoor unit 104. While HVAC system 100 is shown as a so-called split system comprising an indoor unit 102 located separately from the outdoor unit 104, alternative embodiments of the HVAC system 100 may comprise a so-called package system in which one or more of the components of the indoor unit 102 and one or more of the components of the outdoor unit 104 are carried together in a common housing or package.

The indoor unit 102 generally comprises an indoor air handling unit comprising an indoor heat exchanger 108, an indoor fan 110, an indoor metering device 112, and an indoor controller 124. The indoor heat exchanger 108 may generally be configured to promote heat exchange between refrigerant carried within internal tubing of the indoor heat exchanger 108 and an airflow that may contact the indoor heat exchanger 108 but that is segregated from the refrigerant. In some embodiments, the indoor heat exchanger 108 may comprise a plate-fin heat exchanger. However, in other embodiments, indoor heat exchanger 108 may comprise a microchannel heat exchanger and/or any other suitable type of heat exchanger.

The indoor fan 110 may generally comprise an axial fan comprising a fan blade assembly and a fan motor configured to selectively rotate the fan blade assembly. Additionally or alternatively, the indoor fan 110 may comprise a variable speed blower comprising a blower housing, a blower impeller at least partially disposed within the blower housing, and a blower motor configured to selectively rotate the blower impeller. The indoor fan 110 may generally be configured to provide airflow through the indoor unit 102 and/or the indoor heat exchanger 108 to promote heat transfer between the airflow and a refrigerant flowing through the indoor heat exchanger 108. The indoor fan 110 may also be configured to deliver temperature-conditioned air from the indoor unit 102 to one or more areas and/or zones of a climate controlled structure. The indoor fan 110 may generally be configured as a modulating and/or variable speed fan capable of being operated at many speeds over one or more ranges of speeds.

In some embodiments, the indoor fan 110 may comprise a single speed fan. In other embodiments, the indoor fan 110 may be configured as a multiple speed fan capable of being operated at a plurality of operating speeds by selectively electrically powering different ones of multiple electromagnetic windings of a motor of the indoor fan 110. Additionally or alternatively, indoor fan 110 may comprise a mixed-flow fan, a centrifugal blower, and/or any other suitable type of fan and/or blower, such as a multiple speed fan capable of being operated at a plurality of operating speeds by selectively electrically powering different multiple electromagnetic windings of a motor of the outdoor fan 118.

The indoor metering device 112 may generally comprise an electronically-controlled motor-driven electronic expansion valve (EEV). In some embodiments, however, the indoor metering device 112 may comprise a thermostatic expansion valve, a capillary tube assembly, and/or any other suitable metering device. While the indoor metering device 112 may be configured to meter the volume and/or flow rate of refrigerant through the indoor metering device 112, the indoor metering device 112 may also comprise and/or be associated with a refrigerant check valve and/or refrigerant bypass configuration when the direction of refrigerant flow through the indoor metering device 112 is such that the indoor metering device 112 is not intended to meter or otherwise substantially restrict flow of the refrigerant through the indoor metering device 112.

The outdoor unit 104 generally comprises an outdoor heat exchanger 114, a compressor 116, an outdoor fan 118, an outdoor metering device 120, a reversing valve 122, and an outdoor controller 126. In some embodiments, the outdoor unit 104 may also comprise a plurality of temperature sensors for measuring the temperature of the outdoor heat exchanger 114, the compressor 116, and/or the outdoor ambient temperature. The outdoor heat exchanger 114 may generally be configured to promote heat transfer between a refrigerant carried within internal passages of the outdoor heat exchanger 114 and an airflow that contacts the outdoor heat exchanger 114 but that is segregated from the refrigerant. According to some implementations, the outdoor heat exchanger 114 may comprise a plate-fin heat exchanger. According to other implementations, the outdoor heat exchanger 114 may comprise a spine-fin heat exchanger, a microchannel heat exchanger, or any other suitable type of heat exchanger.

The compressor 116 may generally comprise a variable speed scroll-type compressor that may generally be configured to selectively pump refrigerant at a plurality of mass flow rates through the indoor unit 102, the outdoor unit 104, and/or between the indoor unit 102 and the outdoor unit 104. In some embodiments, the compressor 116 may comprise a rotary type compressor configured to selectively pump refrigerant at a plurality of mass flow rates. In alternative embodiments, the compressor 116 may comprise a modulating compressor that is capable of operation over a plurality of speed ranges, a reciprocating-type compressor, a single speed compressor, and/or any other suitable refrigerant compressor and/or refrigerant pump. According to some implementations, the compressor 116 may be controlled by a compressor drive controller 144, also referred to as a compressor drive and/or a compressor drive system.

The outdoor fan 118 may generally comprise an axial fan comprising a fan blade assembly and a fan motor configured to selectively rotate the fan blade assembly. The outdoor fan 118 may generally be configured to provide airflow through the outdoor unit 104 and/or the outdoor heat exchanger 114 to promote heat transfer between the airflow and a refrigerant flowing through the outdoor heat exchanger 114. The outdoor fan 118 may generally be configured as a modulating and/or variable speed fan capable of being operated at a plurality of speeds over a plurality of speed ranges. Additionally or alternatively, the outdoor fan 118 may comprise a mixed-flow fan, a centrifugal blower, and/or any other suitable type of fan and/or blower, such as a multiple speed fan capable of being operated at a plurality of operating speeds by selectively electrically powering different multiple electromagnetic windings of a motor of the outdoor fan 118. In some embodiments, the outdoor fan 118 may be a single speed fan.

The outdoor metering device 120 may generally comprise a thermostatic expansion valve. In some embodiments, however, the outdoor metering device 120 may comprise an electronically-controlled motor driven EEV similar to indoor metering device 112, a capillary tube assembly, and/or any other suitable metering device. While the outdoor metering device 120 may be configured to meter the volume and/or flow rate of refrigerant through the outdoor metering device 120, the outdoor metering device 120 may also comprise and/or be associated with a refrigerant check valve and/or refrigerant bypass configuration when the direction of refrigerant flow through the outdoor metering device 120 is such that the outdoor metering device 120 is not intended to meter or otherwise substantially restrict flow of the refrigerant through the outdoor metering device 120.

The reversing valve 122 may generally comprise a four-way reversing valve. The reversing valve 122 may also comprise an electrical solenoid, relay, and/or other device configured to selectively move a component of the reversing valve 122 between operational positions to alter the flowpath of refrigerant through the reversing valve 122 and consequently the HVAC system 100. Additionally, the reversing valve 122 may also be selectively controlled by the system controller 106 and/or an outdoor controller 126.

The system controller 106 may generally be configured to selectively communicate with an indoor controller 124 of the indoor unit 102, an outdoor controller 126 of the outdoor unit 104, and/or other components of the HVAC system 100. In some embodiments, the system controller 106 may be configured to control operation of the indoor unit 102 and/or the outdoor unit 104. The system controller 106 may also be configured to monitor and/or communicate with a plurality of temperature sensors associated with components of the indoor unit 102, the outdoor unit 104, and/or the ambient outdoor temperature. According to some implementations, the system controller 106 may comprise a temperature sensor and/or a humidity sensor and/or may further be configured to control heating and/or cooling of zones associated with the HVAC system 100. Additionally or alternatively, the system controller 106 may be configured as a thermostat for controlling the supply of conditioned air to zones associated with the HVAC system 100.

The system controller 106 may also generally comprise an input/output (I/O) unit such as a graphical user interface (GUI), a touchscreen interface, or any suitable interface for displaying information and/or receiving user inputs. The system controller 106 may display information related to the operation of the HVAC system 100 and may receive user inputs related to the operation of the HVAC system 100. However, the system controller 106 may further be operable to display information and receive user inputs tangentially and/or unrelated to operation of the HVAC system 100. In some implementations, the system controller 106 may not comprise a display and may derive all information from inputs from remote sensors and remote configuration tools.

In some embodiments, the system controller 106 may be configured for selective bidirectional communication over a communication bus 128. According to one aspect, portions of the communication bus 128 may comprise a three-wire connection suitable for communicating messages between the system controller 106 and one or more of the HVAC system 100 components configured for interfacing with the communication bus 128.

The indoor controller 124 may be carried by the indoor unit 102 and may generally be configured to receive information inputs, transmit information outputs, and/or otherwise communicate with the system controller 106, the outdoor controller 126, and/or any other device via the communication bus 128 and/or any other suitable medium of communication. In some embodiments, the indoor controller 124 may be configured to receive information related to a speed of the indoor fan 110, transmit a control output to an auxiliary heat source, transmit information regarding an indoor fan 110 volumetric flow-rate, communicate with and/or otherwise affect control over an air cleaner, and communicate with an indoor EEV controller. In addition, the indoor controller 124 may be configured to communicate with an indoor fan 110 controller and/or otherwise affect control over operation of the indoor fan 110.

The outdoor controller 126 may be carried by the outdoor unit 104 and may be configured to receive information inputs, transmit information outputs, and/or otherwise communicate with the system controller 106, the indoor controller 124, any other device via the communication bus 128, and/or any other suitable medium of communication. In some embodiments, the outdoor controller 126 may be configured to receive information related to an ambient temperature associated with the outdoor unit 104, information related to a temperature of the outdoor heat exchanger 114, and/or information related to refrigerant temperatures and/or pressures of refrigerant entering, exiting, and/or within the outdoor heat exchanger 114 and/or the compressor 116. In addition, the outdoor controller 126 may be configured to transmit information related to monitoring, communicating with, and/or otherwise affecting control over the compressor 116, the outdoor fan 118, a solenoid of the reversing valve 122, a relay associated with adjusting and/or monitoring a refrigerant charge of the HVAC system 100, a position of the indoor metering device 112, and/or a position of the outdoor metering device 120. The outdoor controller 126 may further be configured to communicate with and/or control a compressor drive controller 144 that is configured to electrically power and/or control the compressor 116.

The HVAC system 100 is shown configured for operating in a so-called cooling mode in which heat is absorbed by refrigerant at the indoor heat exchanger 108 and heat is rejected from the refrigerant at the outdoor heat exchanger 114. In some embodiments, the compressor 116 may be operated to compress refrigerant and pump the relatively high temperature and high pressure compressed refrigerant from the compressor 116 to the outdoor heat exchanger 114 through the reversing valve 122 and to the outdoor heat exchanger 114. As the refrigerant is passed through the outdoor heat exchanger 114, the outdoor fan 118 may be operated to move air into contact with the outdoor heat exchanger 114, thereby transferring heat from the refrigerant to the air surrounding the outdoor heat exchanger 114. The refrigerant may primarily comprise liquid phase refrigerant and the refrigerant may flow from the outdoor heat exchanger 114 to the indoor metering device 112 through and/or around the outdoor metering device 120 which does not substantially impede flow of the refrigerant in the cooling mode. The indoor metering device 112 may meter passage of the refrigerant through the indoor metering device 112 so that the refrigerant downstream of the indoor metering device 112 is at a lower pressure than the refrigerant upstream of the indoor metering device 112. The pressure differential across the indoor metering device 112 allows the refrigerant downstream of the indoor metering device 112 to expand and/or at least partially convert to a two-phase (vapor and gas) mixture. The two-phase refrigerant may enter the indoor heat exchanger 108. As the refrigerant is passed through the indoor heat exchanger 108, the indoor fan 110 may be operated to move air into contact with the indoor heat exchanger 108, thereby transferring heat to the refrigerant from the air surrounding the indoor heat exchanger 108, and causing evaporation of the liquid portion of the two-phase mixture. The refrigerant may thereafter re-enter the compressor 116 after passing through the reversing valve 122.

To operate the HVAC system 100 in the so-called heating mode, the reversing valve 122 may be controlled to alter the flow path of the refrigerant, the indoor metering device 112 may be disabled and/or bypassed, and the outdoor metering device 120 may be enabled. In the heating mode, refrigerant may flow from the compressor 116 to the indoor heat exchanger 108 through the reversing valve 122, the refrigerant may be substantially unaffected by the indoor metering device 112, the refrigerant may experience a pressure differential across the outdoor metering device 120, the refrigerant may pass through the outdoor heat exchanger 114, and the refrigerant may re-enter the compressor 116 after passing through the reversing valve 122. Most generally, operation of the HVAC system 100 in the heating mode reverses the roles of the indoor heat exchanger 108 and the outdoor heat exchanger 114 as compared to their operation in the cooling mode.

Figure 2A:
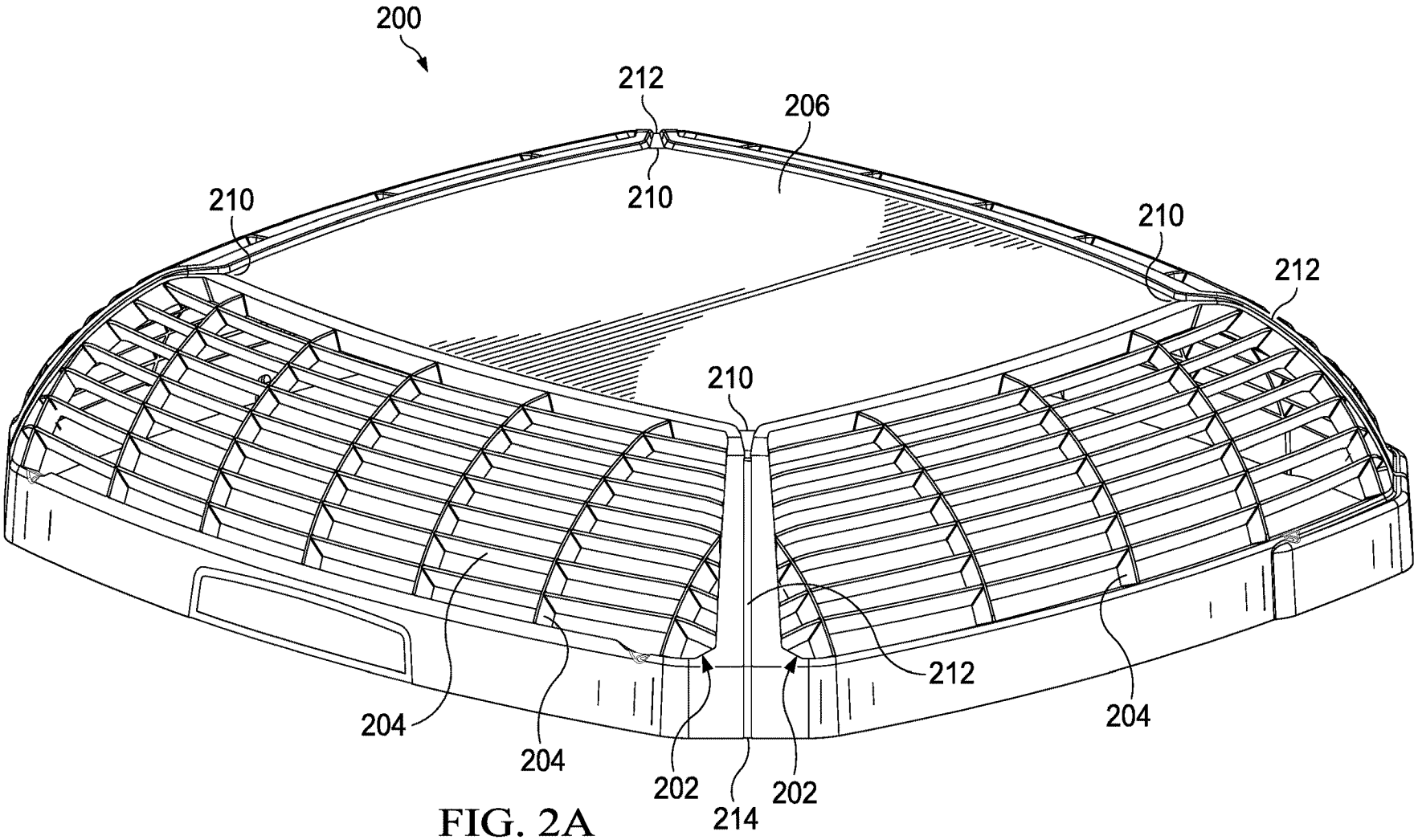
FIG. 2A is an isometric diagram of a top cover according to an embodiment of the disclosure.
Figure 2B:
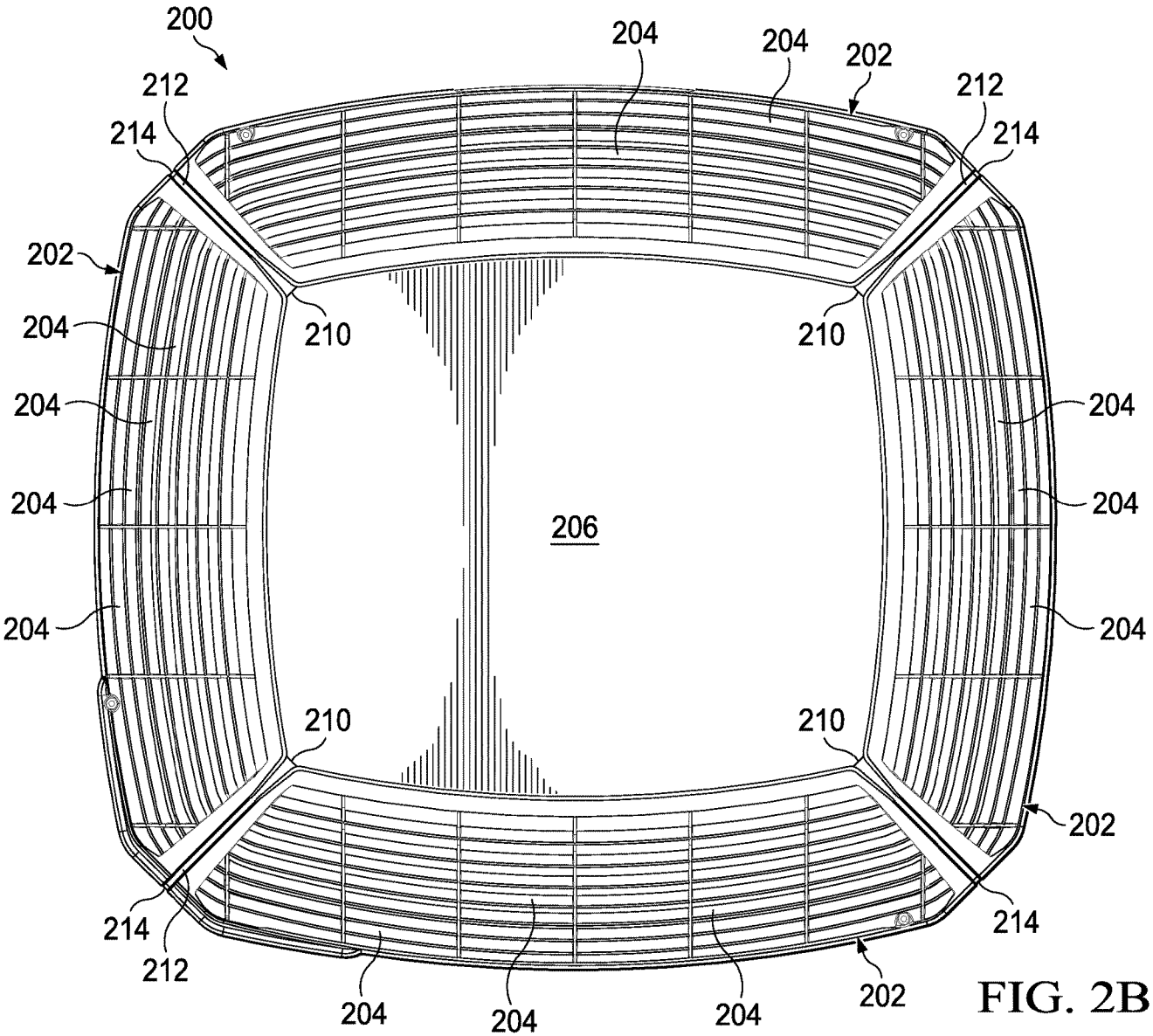
FIG. 2B is a top view of the top cover shown in FIG. 2A.
Figure 2C:
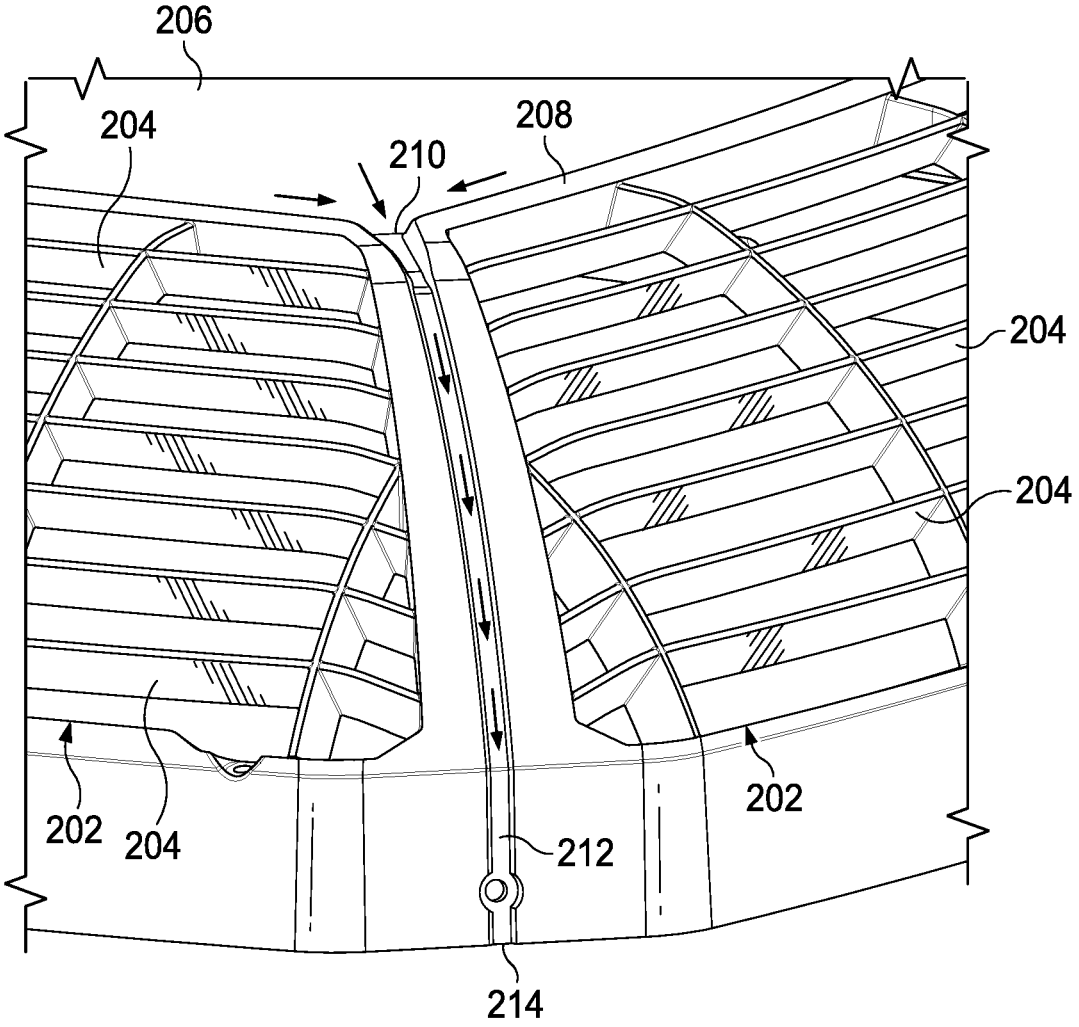
FIG. 2C is an exploded view of a portion of the top cover shown in FIGS. 2A and 2B.

Referring now to FIGS. 2A-2C, a schematic diagram is shown of a top cover 200 according to an embodiment of the disclosure. In general, the top cover 200 may be composed of material(s) designed to protect an outdoor unit (e.g., outdoor unit 104) and/or its components (e.g., heat exchanger 114, compressor 116, fan 118, etc.) from external elements. For example, the top cover 200 may be composed from one or more high-grade plastics, metals, or other suitable materials configured to protect the outdoor unit and/or its components from foreign objects and/or withstand harsh weather conditions.

The overall shape and dimensions of the top cover 200 may be modified to accommodate the particular type of outdoor unit (or component thereof) for which the top cover 200 is intended. Thus, while the top cover 200 is depicted as having a boxlike structure, it is to be understood that the top cover 200 may comprise any suitable shape and/or configuration in other implementations. Further, while the top cover 200 is depicted as a stand-alone cover, the top cover 200 may be integrated with a particular type of outdoor unit (or component thereof) in other implementations.

The top cover 200 comprises one or more ventilated grilles 202 having a plurality of louvers 204 through which air may pass. FIGS. 2A-2C depict the top cover 200 as having four ventilated grilles 202, but it is to be understood that the top cover 200 may comprise fewer ventilated grilles 202 in other implementations. Further, one or more of the ventilated grilles 202 may comprise a different number of louvers 204 in other implementations.

In an embodiment, the top cover 200 comprises a dome-shaped top surface 206 that generally slopes downward from the center of the top cover 200 to its periphery. The periphery of the top cover 200 may be at least partially surrounded by raised edges 208 at each side of the top cover 200. As best seen from FIGS. 2B and 2C, the adjacent edges 208 may be separated from one another at the corners of the top surface 206, with each corner defining an inlet 210 of a channel 212. Each channel 212 is configured to drain water from the top surface 206 to a respective outlet 214, which may lead to a drain pipe (not shown) or other suitable mechanism for discharging water from the top surface 206 and away the louvers 214, such as shown in FIG. 2C. In some embodiments, water exiting the outlets 214 may simply slide down sidewalls of the outdoor unit to which the top cover 200 is attached.

Functionally, the top cover 200 is configured such that during periods of freezing rain or snow, the dome-shaped top surface 206 may channel water or snow toward the periphery of the top cover 200, while the raised edges 208 may prevent water or snow from flowing beyond the edges 208 and over the louvers 204 of the ventilated grilles 202. As shown in FIG. 2C, the combination of the dome-shaped top surface 206 and raised edges 208 enable the top cover 200 to funnel water or snow toward the inlets 210, where water or snow may then drain from the channels 212 via the outlets 214.

Accordingly, the top cover 200 may be viewed as having an integrated guttering system by which water or snow may be drained from the top surface 206 via the corners, while preventing such water or snow from flowing over the ventilated grilles 202 and onto the louvers 204, where ice formation and buildup may otherwise occur. As such, the top cover 200 may minimize the possibility of ice blocking airflow through the louvers 204 (i.e., by funneling water or snow away from the ventilated grilles 202), thereby allowing an outdoor unit (e.g., unit 104) for which the top cover 200 is used to maintain operating efficiency and avoid failure.

During periods of heavy snowfall or freezing rain, water exposure to at least some parts of the ventilated grilles 202 may be inevitable. In some embodiments, the louvers 204 may be angled so to as prevent or minimize freezing water from building up and over the louvers 204 during such periods. For example, the louvers 204 may be oriented at an increased angle from the horizontal such that in the event freezing rain contacts the louvers 204, freezing rain dripping down from higher-level louvers 204 may be less likely to contact lower-level louvers 204 as compared to if the louvers 204 were oriented at a relatively flatter angle. According to some aspects, the louvers 204 may be angled from the horizontal at an angle ranging from about 45 degrees to 75 degrees. For example, to promote improved airflow, the louvers 204 may be angled from the horizontal at about 60 degrees.

In some embodiments, the raised edges 208 may be shaped and/or oriented such that as the level of snow and/or freezing rain within the top cover 200 rises, water surrounding the raised edges 208 may freeze thereon so as to extend the height of the raised edges 208. This way, water resulting from ice, rain, or snow may remain confined within the top cover 200 and ultimately be funneled towards the corners and down through the sides channels 212 as discussed above. Thus, even in situations where the level of accumulated snow/water may otherwise exceed the height of the raised edges 208, the natural formation of ice above and/or around the raised edges 208 can prevent water from flowing over the ventilated grilles 202 and onto the louvers 202.

Figure 3A:
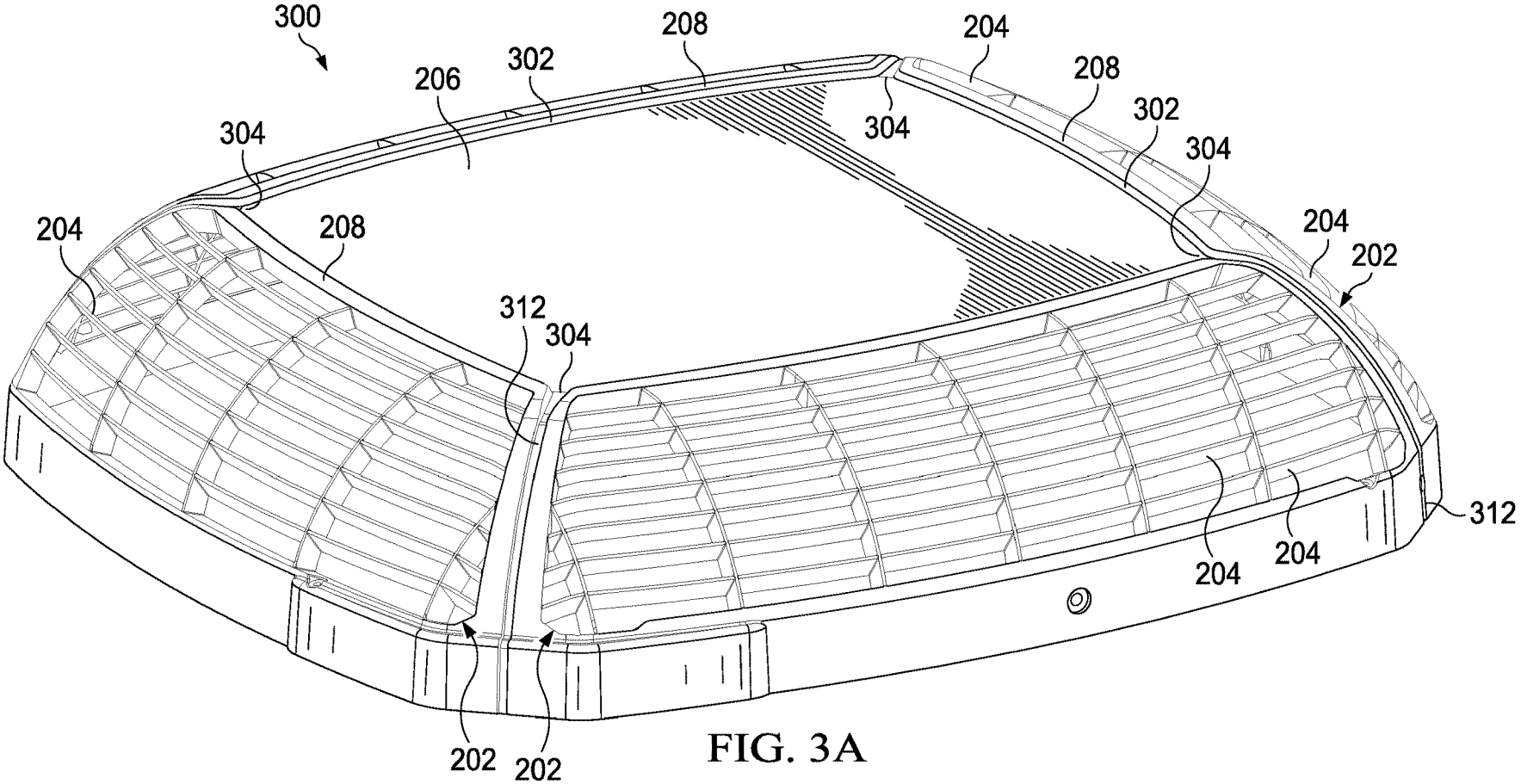
FIG. 3A is an isometric diagram of a top cover according to an embodiment of the disclosure.
Figure 3B:
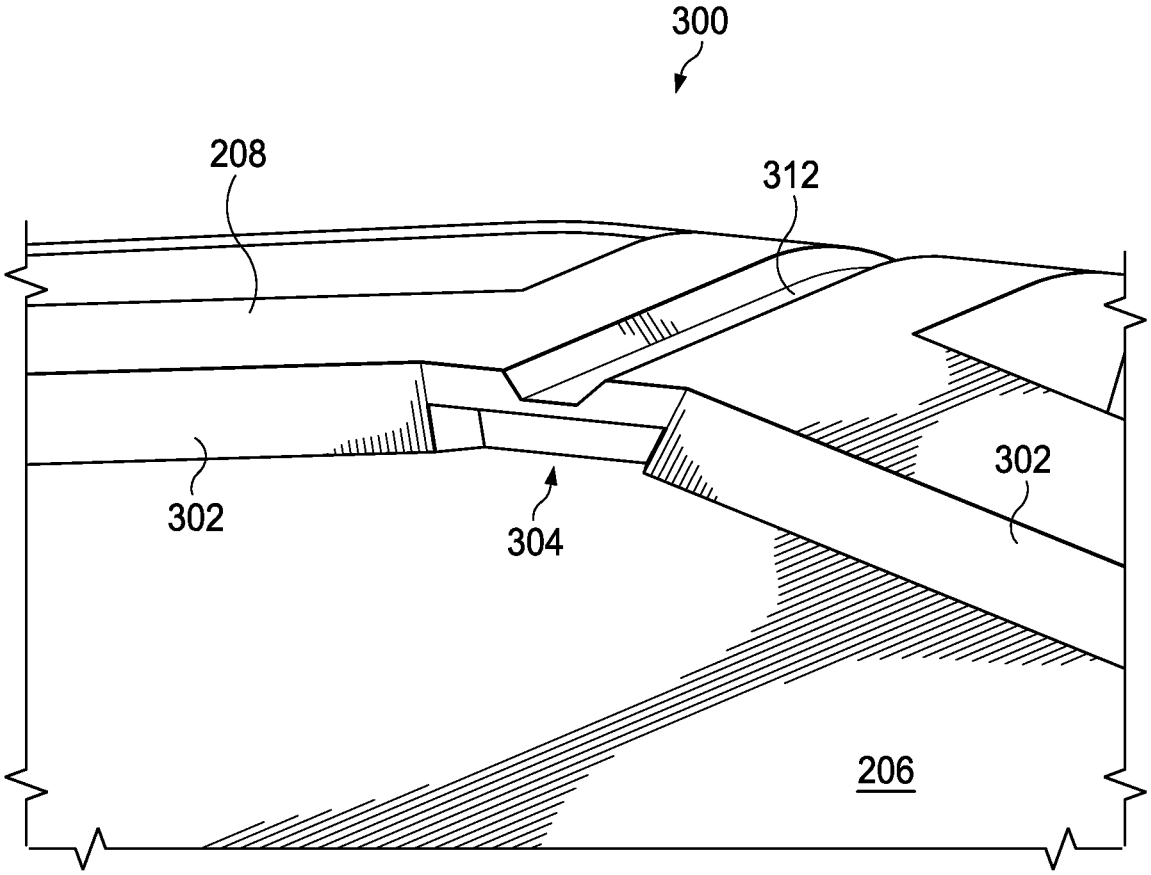
FIG. 3B is an exploded view of a portion of the top cover shown in FIG. 3A.

FIG. 3A depicts a schematic diagram of a top cover 300 according to an embodiment of the disclosure, while FIG. 3B depicts an exploded view of a right-hand portion of the top cover 300. Unless stated otherwise, the top cover 300 may be substantially similar to the top cover 200 of FIGS. 2A and 2B. Therefore, the concepts discussed above with respect to FIGS. 2A and 2B are similarly applicable to the top cover 300 of FIG. 3. One distinction between the two covers is that the top cover 300 may employ different water mitigation techniques to prevent water from flowing over the ventilated grill 202 and onto the louvers 204.

For example, the top cover 300 may include a portion between the top surface 206 and raised edges 208 that defines at least one groove or outer channel 302. The outer channel 302 may fluidly connect to a plurality of integrated drain holes 304 at each corner of the top surface 206, such as been shown in FIG. 3B. In some implementations, the top cover 300 may include more or less drain holes 304 than shown in FIG. 3A. Moreover, the top cover 300 may include one or more drain holes 304 at different locations than shown in FIG. 3A.

Functionally, the top cover 300 is configured such that during periods of freezing rain or snow, the dome-shaped top surface 206 may direct water or snow toward the outer channel 302, while the raised edges 208 may prevent water or snow from flowing above the edges 208 and over the louvers 204 of the ventilated grilles 202. The combination of the dome-shaped top surface 206 and raised edges 208 enable the outer channel to funnel water or snow toward the drain holes 304, which may fluidly connect to respective tubes and/or outlets (not shown) through which water may exit the top cover 300.

In some embodiments, the top cover 300 may include one or more secondary channels 312 similar to the channels 212 in FIGS. 2A-2C. This way, should entry into any of the drain holes 304 become blocked (e.g., due to debris or ice), water accumulated within the top cover 300 may still be funneled towards the corners and drained from the secondary channels 312 such as discussed above with respect to FIGS. 2A-2C. Thus, the secondary channels 312 may provide the top cover 300 an additional mechanism to prevent water from flowing over the ventilated grill 202 and onto the louvers 204.

Furthermore, it should be understood that the disclosed systems and methods may be embodied in many other specific forms without departing from the spirit or scope of the present disclosure. The present examples are to be considered as illustrative and not restrictive, and the intention is not to be limited to the details given herein. For example, the various elements or components may be combined or integrated in another system or certain features may be omitted or not implemented.

At least one embodiment is disclosed and variations, combinations, and/or modifications of the embodiment(s) and/or features of the embodiment(s) made by a person having ordinary skill in the art are within the scope of the disclosure. Alternative embodiments that result from combining, integrating, and/or omitting features of the embodiment(s) are also within the scope of the disclosure. Where numerical ranges or limitations are expressly stated, such express ranges or limitations should be understood to include iterative ranges or limitations of like magnitude falling within the expressly stated ranges or limitations (e.g., from about 1 to about 10 includes, 2, 3, 4, etc.; greater than 0.10 includes 0.11, 0.12, 0.13, etc.). For example, whenever a numerical range with a lower limit, $R_l$, and an upper limit, $R_u$, is disclosed, any number falling within the range is specifically disclosed. In particular, the following numbers within the range are specifically disclosed: $R=R_l+k*(R_u-R_l)$, wherein k is a variable ranging from 1 percent to 100 percent with a 1 percent increment, i.e., k is 1 percent, 2 percent, 3 percent, 4 percent, 5 percent, . . . , 50 percent, 51 percent, 52 percent, . . . , 95 percent, 96 percent, 97 percent, 98 percent, 99 percent, or 100 percent. Unless otherwise stated, the term "about" shall mean plus or minus 10 percent of the subsequent value.

Moreover, any numerical range defined by two R numbers as defined in the above is also specifically disclosed. Use of the term "optionally" with respect to any element of a claim means that the element is required, or alternatively, the element is not required, both alternatives being within the scope of the claim. Use of broader terms such as comprises, includes, and having should be understood to provide support for narrower terms such as consisting of, consisting essentially of, and comprised substantially of. Accordingly, the scope of protection is not limited by the description set out above but is defined by the claims that follow, that scope including all equivalents of the subject matter of the claims. Each and every claim is incorporated as further disclosure into the specification and the claims are embodiment(s) of the present invention.

What is claimed is:

1. A top cover for an outdoor heating, ventilation, and/or air conditioning (HVAC) unit, the top cover comprising:
- an outer periphery configured to be coupled to the outdoor HVAC unit;
- a dome-shaped top surface;
- outer edges surrounding the dome-shaped top surface;
- at least one ventilated grille disposed between the outer edges and the outer periphery; and
- a plurality of channels configured to drain water from the outer edges toward the outer periphery, and away from the at least one ventilated grille.

2. The top cover of claim 1, wherein the outer edges are raised so as to prevent water from flowing above the raised edges and over the at least one ventilated grille.

3. The top cover of claim 2, wherein the dome-shaped top surface slopes downward from a center of the dome-shaped top surface so as to direct water toward the outer edges.

4. The top cover of claim 3, wherein the dome-shaped top surface and the outer edges are configured to cooperatively funnel water to the plurality of channels.

5. The top cover of claim 1, wherein the plurality of channels comprise a plurality of respective inlets, each inlet being disposed at a corner of the dome-shaped top surface.

6. The top cover of claim 1, wherein the at least one ventilated grille comprises a pair of ventilated grilles, and wherein one of the plurality of channels extends between the pair of ventilated grilles.

7. The top cover of claim 1, further comprising a plurality of drain holes, each drain hole being disposed at a corner of the dome-shaped top surface.

8. The top cover of claim 7, wherein the dome-shaped top surface and the outer edges define at least one groove configured to fluidly connect to the plurality of drain holes.

9. The top cover of claim 1, wherein the at least one ventilated grille comprises a plurality of louvers through which air is selectively discharged from the outdoor unit.

10. The top cover of claim 9, wherein the plurality of louvers are oriented at an increased angle from a horizontal plane.

11. A heating, ventilation, and/or air conditioning (HVAC) system, comprising:
- an outdoor unit; and
- a top cover configured to shield an interior of the outdoor unit, the top cover comprising:
  - an outer periphery coupled to the outdoor unit;
  - a dome-shaped top surface;
  - outer edges surrounding the dome-shaped top surface;
  - at least one ventilated grille disposed between the outer edges and the outer periphery; and
  - a plurality of channels configured to drain water from the outer edges toward the outer periphery, and away from the at least one ventilated grille.

12. The HVAC system of claim 11, wherein the outer edges are raised so as to prevent water from flowing above the raised edges and over the at least one ventilated grille.

13. The HVAC system of claim 12, wherein the dome-shaped top surface slopes downward from a center of the dome-shaped top surface so as to direct water toward the outer edges.

14. The HVAC system of claim 13, wherein the dome-shaped top surface and the outer edges are configured to cooperatively funnel water to the plurality of channels.

15. The HVAC system of claim 11, wherein the plurality of channels comprise a plurality of respective inlets, each inlet being disposed at a corner of the dome-shaped top surface.

16. The HVAC system of claim 11, wherein the at least one ventilated grille comprises a pair of ventilated grilles, and wherein one of the plurality of channels extends between the pair of ventilated grilles.

17. The HVAC system of claim 11, further comprising a plurality of drain holes, each drain hole being disposed at a corner of the dome-shaped top surface.

18. The HVAC system of claim 17, wherein the dome-shaped top surface and the outer edges define at least one groove configured to fluidly connect to the plurality of drain holes.

19. The HVAC system of claim 11, wherein the at least one ventilated grille comprises a plurality of louvers through which air is selectively discharged from the outdoor unit.

20. The HVAC system of claim 19, wherein the plurality of louvers are oriented at an increased angle from a horizontal plane.

* * * * *